US005337890A

United States Patent [19]

Lai

[11] Patent Number: 5,337,890

[45] Date of Patent: Aug. 16, 1994

[54] CYLINDRICAL VANITY CASE

[76] Inventor: Chin-Chun Lai, No. 21, Pu Ting Rd., Shinchu Shiang, Taiwan

[21] Appl. No.: 108,343

[22] Filed: Aug. 18, 1993

[51] Int. Cl.[5] ..... B65D 69/00; A45D 33/20; A45D 42/00

[52] U.S. Cl. ..... 206/235; 132/296; 132/304; 132/314; 132/316; 206/581

[58] Field of Search ..... 206/234, 235, 581, 38; 132/293–299, 301–307, 314–318

[56] References Cited

U.S. PATENT DOCUMENTS

| | | | |
|---|---|---|---|
| 2,049,378 | 7/1936 | Holl | 206/235 X |
| 2,100,999 | 11/1937 | Anderson | 206/581 X |
| 2,458,020 | 1/1949 | Olsen | 132/316 |
| 2,512,476 | 6/1950 | Birnkrant et al. | 206/235 X |
| 3,441,033 | 4/1969 | Flax | 132/295 |
| 3,502,089 | 3/1970 | Paradis | 132/294 |
| 4,777,969 | 10/1988 | Holloway | 132/314 |
| 5,226,541 | 7/1993 | Huang | 206/581 |

FOREIGN PATENT DOCUMENTS

| | | | |
|---|---|---|---|
| 263425 | 11/1949 | Switzerland | 206/235 |

*Primary Examiner*—Bryon P. Gehman
*Attorney, Agent, or Firm*—Pro-Techtor International

[57] ABSTRACT

A cylindrical vanity case comprises mainly a case cover, a left case body, a right case body, and a mirror frame. The left case body, the right case body and the mirror frame are pivotally attached so that they can be turned to spread out. The cylindrical vanity case is provided with cellular compartments and slots for keeping therein a variety of cosmetics, such as eye shadow powder, rouge, lipstick, powder cake, eye colorstick, mascara, lip brush, brow brush, etc. The cylindrical vanity case is compact and can be carried easily and conveniently.

1 Claim, 5 Drawing Sheets

CYLINDRICAL VANITY CASE

BACKGROUND OF THE INVENTION

The present invention relates generally to a cosmetic product, and more particularly to a vanity case having a cylindrical shape.

It is a social norm as well as a way of expressing gracious politeness that a woman wears cosmetics, which improve and beautify the appearance of the woman. The cosmetics are therefore indispensable goods that are used daily by the woman at large. There are a variety of cosmetics, such as lipstick, rouge, mascara, facial cream, perfume, powder, eye colorstick, eye shadow powder, lip brush, etc. Such cosmetic articles as mentioned above can not be kept in a handbag in an organized manner. Therefore, a vanity case is generally used by the woman for carrying the cosmetics, especially when she travels. However, the conventional vanity case is generally limited in design in that it is excessively large and heavy and can not be therefore carried easily and conveniently.

SUMMARY OF THE INVENTION

It is therefore the primary objective of the present invention to provide a vanity case which is compact and cylindrical in shape.

The foregoing objective of the present invention is attained by a cylindrical vanity case, which comprises mainly a case cover, a left case body, a right case body, and a mirror frame. The left case body, the right case body and the mirror frame are pivotally attached so that they can be turned to spread out. The cylindrical case is provided with cellular compartments and slots for keeping therein a variety of cosmetics, such as eye shadow powder, rouge, lipstick, powder cake, eye colorstick, mascara, lip brush, etc. The cylindrical vanity case can be carried easily and conveniently.

The foregoing objective, features and functions of the present invention can be more readily understood by studying the following detailed description of the present invention in conjunction with the accompanying drawings.

DETAILED DESCRIPTION OF THE INVENTION

Figure 1:
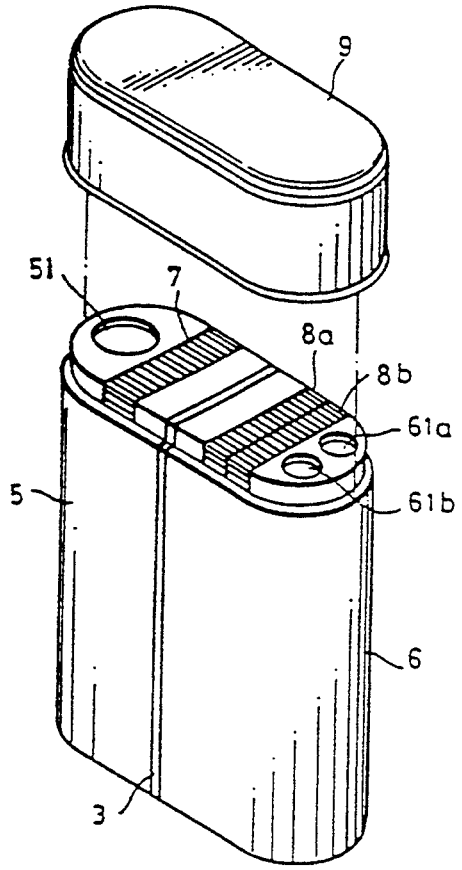
FIG. 1 shows a perspective view of the present invention.
Figure 2:
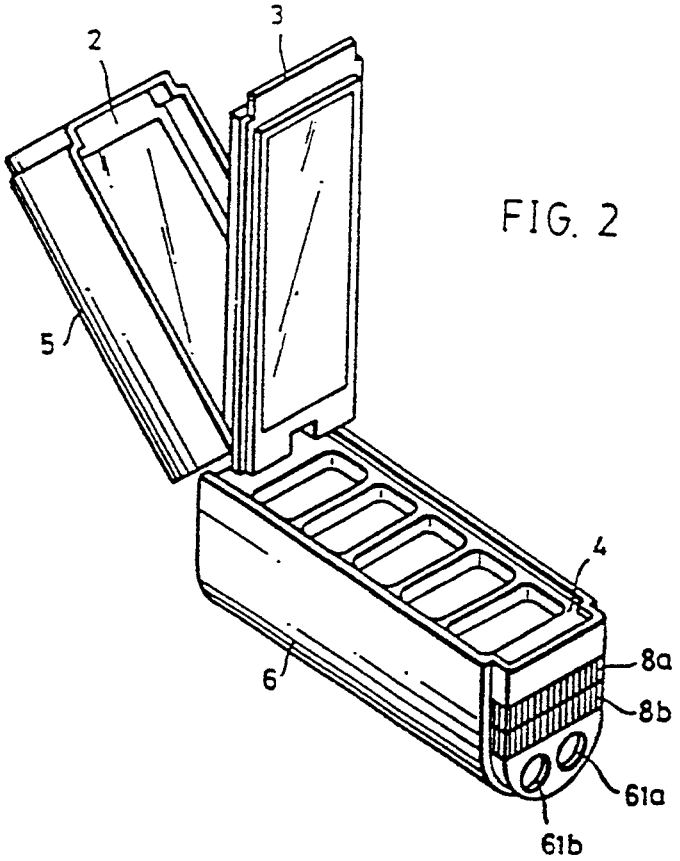
FIG. 2 is a perspective view showing that the left case body, the right case body and the mirror frame of the present invention are turned to spread out.
Figure 3:
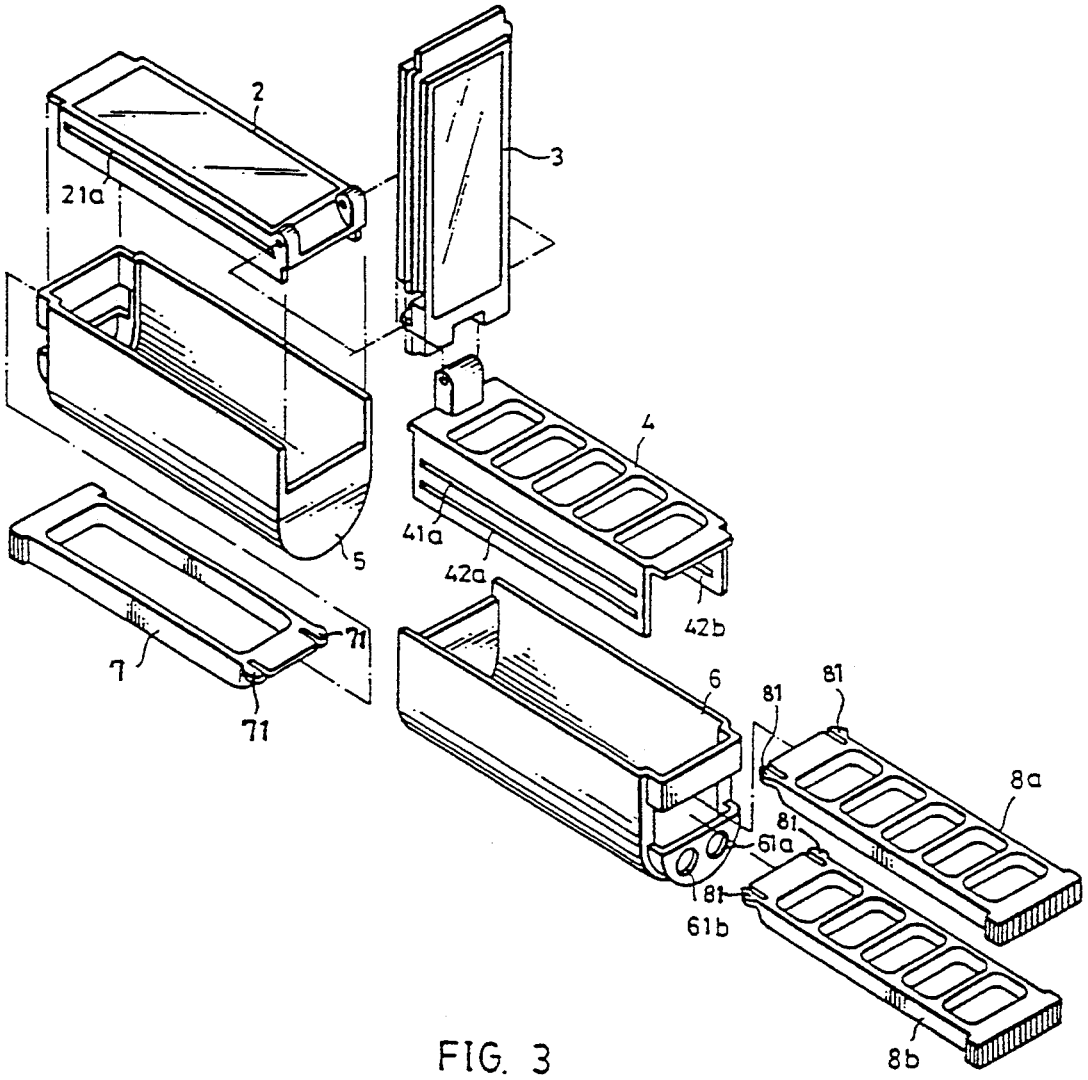
FIG. 3 shows an exploded view of the present invention.

As shown in FIGS. 1–3, a cylindrical vanity case embodied in the present invention is shown to comprise a left inner frame 2, a mirror frame 3, a right inner frame 4, a left case body 5, a right case body 6, a tool drawer 7, powder drawers 8*a* and 8*b*, and a case cover 9.

The left inner frame 2, the mirror frame 3, and the right inner frame 4 are disposed in that order and have respectively a bottom end provided with a coaxial hole by means of which they are pivotally attached so that they can be turned to spread out. The left inner frame 2 has two side walls 2*a* and 2*b*, which are provided respectively with slide grooves 21*a* and 21*b*. The right inner frame 4 has two side walls provided with slide grooves 41*a*, 41*b*, 42*a* and 42*b*. Disposed in each of the slide grooves 21*a*, 21*b*, 41*a*, 41*b*, 42*a* and 42*b* is a slide rail for use in sliding the tool drawer 7 and the powder drawers 8*a* and 8*b*. The tool drawer 7 includes tabs 71, while the powder drawers 8*a* and 8*b* include tabs 81. The tabs fit into the slide grooves to enable the drawers to slide. The left case body 5 and the right case body 6 are each provided with a left insertion hole 51 and a pair of right insertion holes 61*a* and 61*b*, which form together a fixed point axis for spreading out the left case body 5 and the right case body 6. A mirror is mounted in the mirror frame 3. The tool drawer 7 is used to keep the cosmetic articles such as the eye shadow applicator, the rough brush, the lip brush and the like. The left insertion hole 51 is intended for use in keeping a mascara. The mirror frame 3 has one side in which a mirror is mounted and another side in which a dual color rouge is disposed. The right inner frame 4 is designed to accommodate five different kinds of eye shadow powders. The powder drawers 8*a* and 8*b* may be used to keep additional eye shadow powders and the lipsticks. The right insertion holes 61*a* and 61*b* may be used respectively for keeping a lip colorstick and an eye colorstick.

Figure 4:
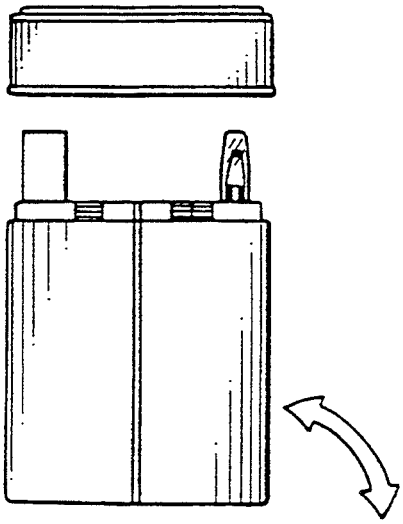
FIG. 4 is a schematic view showing the method of using the present invention.
Figure 5:
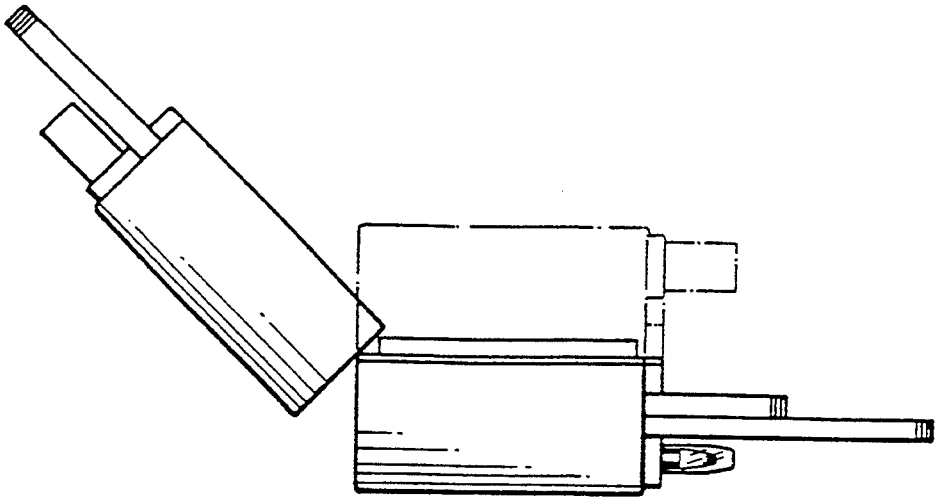
FIG. 5 is a schematic view showing the present invention in use.
Figure 6:
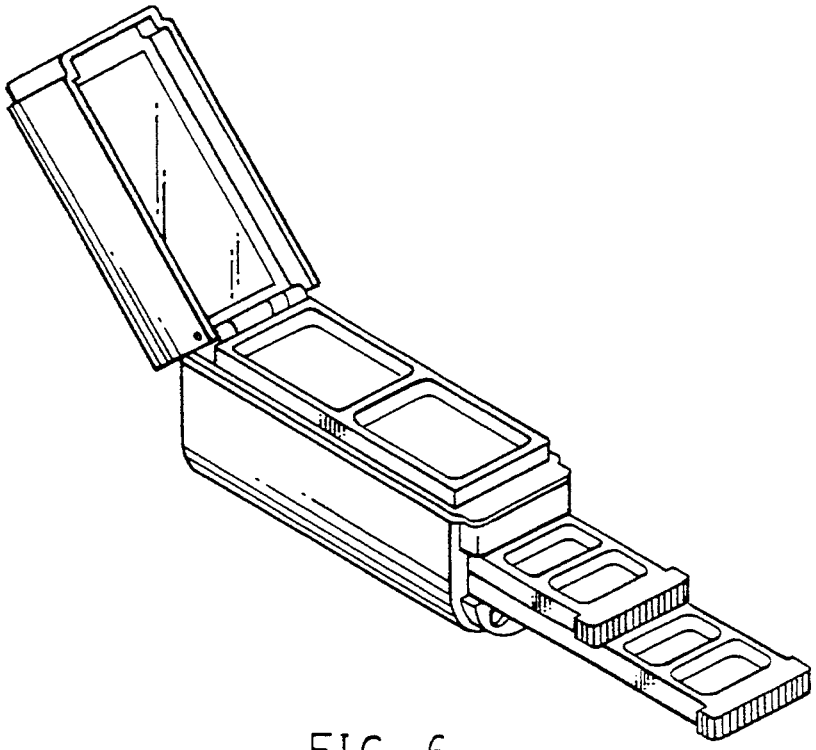
FIG. 6 is a perspective view showing the present invention in use.
Figure 7:
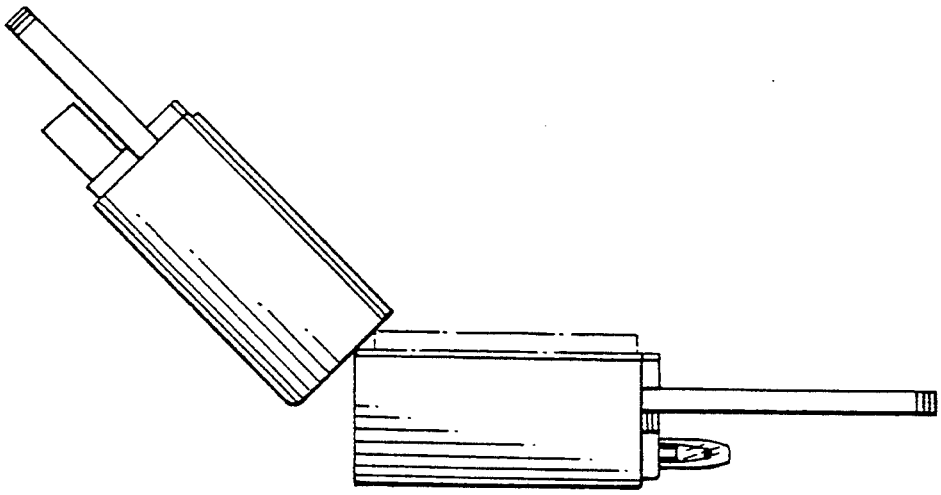
FIG. 7 is another perspective view showing the present invention in use.
Figure 8:
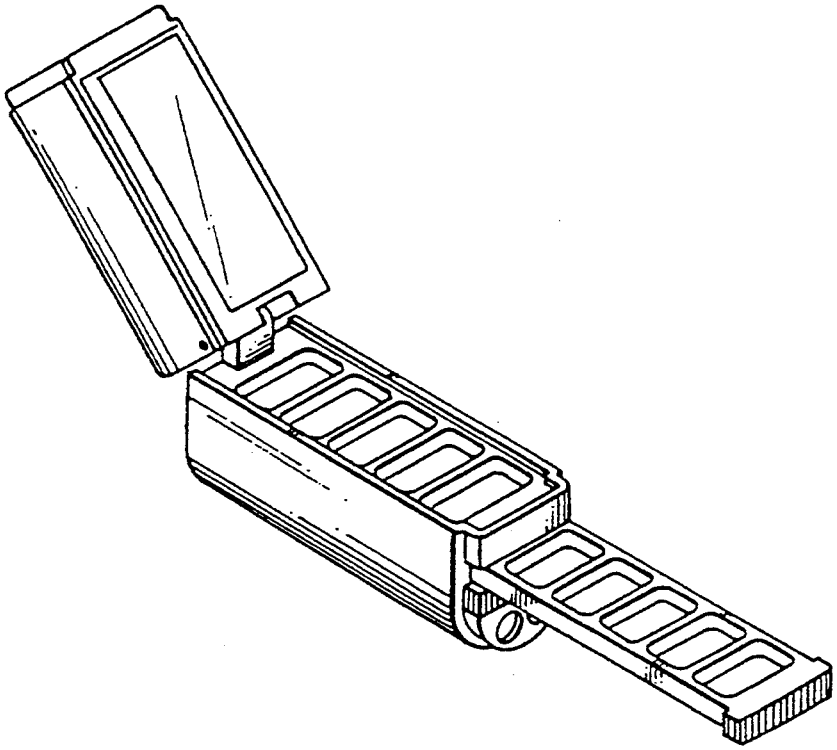
FIG. 8 is still another perspective view showing the present invention in use.

As illustrated in FIGS. 4 and 5, upon removing the case cover 9, the user uses her hand to hold the lower edge of the right case body 6 to lift with another hand the left case body 5 so as to permit all the drawers to be pulled out. In other words, the left case body 5 and the right case body 6 can be caused to turn in a 90-degree angle. As a result, all cosmetics kept in the cylindrical vanity ease of the present invention can be made available to the user, as shown in FIG. 6. The mirror is also made available to the user. The eye shadow powders kept in the right inner frame 4 can be made available by lifting the mirror frame 3, as shown in FIG. 8.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

I claim:

1. A cylindrical vanity case comprising:

a left inner frame having a receiving slot located in a top portion thereof and having two opposing side walls, each wall being provided with a slide groove;

a mirror frame having a first side provided with a mirror slot and a second side provided with a receiving slot;

a right inner frame having a receiving slot located in a top portion thereof and having two opposing side walls, each wall being provided with a slide groove;

said mirror frame being disposed between said left inner frame and said right inner frame such that said left inner frame, said mirror frame, and said right inner frame are pivotally attached to a common axis of rotation by means of coaxial holes located on a bottom end of each of said left inner frame, said mirror frame, and said right inner frame;

a left case body with an insertion slot located at a top portion thereof, said left case body being fastened to said left inner frame;

a right case body fastened to said right inner frame and provided with a pair of insertion slots;

a tool drawer slidable with tabs on an inner end thereof, said tabs fitting into said slide grooves of said left inner frame, thereby making the tool drawer slidable into and out of said left case body along said slide grooves of said left inner frame;

a plurality of powder drawers each with tabs on an inner end thereof, said tabs fitting into said slide grooves of said right inner frame, thereby making the powder drawers slidable into and out of said right case body along said slide grooves of said right inner frame; and a case cover shielding said left case body, said right case body and said mirror frame.

* * * * *